US005682865A

United States Patent [19]

Maekawa et al.

[11] Patent Number: 5,682,865

[45] Date of Patent: Nov. 4, 1997

[54] ELECTRICAL CONNECTOR AND IGNITION APPARATUS FOR AN INTERNAL COMBUSTION ENGINE

[75] Inventors: Toshio Maekawa; Shigemi Murata; Mitsuru Koiwa, all of Tokyo, Japan

[73] Assignee: Mitsubishi Denki Kabushiki Kaisha, Tokyo, Japan

[21] Appl. No.: 612,822

[22] Filed: Mar. 11, 1996

[30] Foreign Application Priority Data

Apr. 26, 1995 [JP] Japan ..... 7-102117

[51] Int. Cl.[6] ..... F02P 13/00; H01R 11/16

[52] U.S. Cl. ..... 123/635; 123/169 PA; 439/125

[58] Field of Search ..... 123/635, 647, 123/169 PA, 169 PH; 439/125, 127

[56] References Cited

U.S. PATENT DOCUMENTS 5,146,906 9/1992 Agatsuma ..... 123/635
5,456,609 10/1995 Imanishi ..... 439/125

FOREIGN PATENT DOCUMENTS 64-8580 1/1989 Japan .

*Primary Examiner*—Andrew M. Dolinar
*Attorney, Agent, or Firm*—Sughrue, Mion, Zinn, Macpeak & Seas, PLLC

[57] ABSTRACT

An electrical connector connecting a spark plug to an ignition coil comprising electrically insulating caps each having a cylindrical engaging surface adapted to be attached to the spark plug and the ignition coil. An electrically insulating sheath is attached and engaged with the engaging surfaces of the insulating caps at the engaging surfaces at its opposite ends so that at least one cylindrical engaging interface is defined therebetween. An electrical conductor is supported by and extended through the insulating sheath for electrically connecting the ignition coil and the high voltage terminal of the spark plug to each other. The electrical connector also comprises an electrically insulating structure, disposed in the engaging interface between the engaging surfaces of the caps and the sheath, for providing additional electrical insulation in the engaging interface. The insulating structure may be a circumferential annular ridge and groove in the engaging interface, an electrically insulating bonding agent disposed in the engaging interface, an axially extending annular wall and groove, or a circumferential annular space defined in the engaging interface between the engaging surfaces and a volume of electrically insulating bonding agent filled within the annular space.

8 Claims, 11 Drawing Sheets

ELECTRICAL CONNECTOR AND IGNITION APPARATUS FOR AN INTERNAL COMBUSTION ENGINE

BACKGROUND OF THE INVENTION

This invention relates to an electrical connector and ignition apparatus for an internal combustion engine.

Generally, the ignition apparatus of an internal combustion engine functions to transmit a high voltage supplied from the ignition coil through an electrical connector or transmitting device to a spark plug. FIG. 12 is a sectional view of a conventional ignition apparatus for an internal combustion engine of the plug direct attachment type, FIG. 13 is a sectional view of the main portion of the connection portion to the ignition coil. In these figures, reference numeral 1 is a cylinder head, 2 are plug holes provided in the cylinder head 2, and 3 is a spark plug thread-engaged within the plug holes 2.

Reference numeral 4 is an ignition apparatus for an internal combustion engine which has an ignition coil 5 and the connector 6. As illustrated in FIG. 13, the ignition coil 5 is provided with a high voltage side terminal 5*a* at which a high voltage is generated and a projection portion 5*b* made of PBT (polybthyrenetelephtarate) to surround the high voltage side terminal 5*a*. In the electrical connector 6, reference numeral 7 is an electrically insulating coating, 8 is an electrical conductor, the insulating coating 7 is made of an electrically insulating material such as PBT. The insulating coating 7 has an enlarged diameter end portion at the ignition plug side which has a thin wall cylindrical portion to define a cylindrical support sleeve 7*a*, and a spring 11 which will be described in more detail is accommodated within the support sleeve 7*a*.

Also, as shown in FIG. 13, the other end on the side of the ignition coil 5 is also enlarged in diameter and thin in wall thickness to provide a thin-walled cylindrical portion 7*d* which is a cylindrical support sleeve 7*c*. The support sleeve 7*c* accommodates the spring 13 therein which is electrically connected to the other end of the conductor 8. The conductor 8 may be made of a sufficiently rigid brass rod member and may be isolated from the outside with the insulating cover 7.

Reference numeral 9 is a plug side elastic member, which has an inner hollow cylinder portion 9*b* having formed at its central portion an fitting bore 9*a* engaging and fitting with the spark plug 3. The plug side elastic member 9 also comprises an outer cylinder portion 9*d* disposed outside of the inner cylinder portion 9*b* to define an engagement groove 9*c* therebetween, and an reinforcement flange portion 9*e* disposed at an upper end (as seen in the figure) of the outer cylinder portion 9*d*. These portions are all made of silicone rubber having a predetermined elasticity in an integral, unitary structure.

Within the engagement groove 9*c* of the plug side elastic member 9, a thin-wall cylinder portion 7*b* of the insulating cover 7 is inserted. Reference numeral 10 is a bonding agent of a silicone rubber or the like which connects the outer periphery of the cylindrical support sleeve 7*a* of the insulating cover 7 to the inner periphery of the outer cylindrical portion 9*d*. It is necessary that the conductor 8, the spring 11 and the conductor portion 3*a* of the spark plug 3 must be electrically insulated from the grounded member such as cylinder head 1 or the like. Therefore, the electrically insulating bonding agent 10 is inserted between the outer periphery of the support sleeve 7*a* and the inner periphery of the outer cylindrical portion 9*d* in order not to generate a gap through which an electric current leaks. The support sleeve 7*a* is inserted into the engagement groove 9*c* after the bonding agent 10 is applied on its outer circumferential surface over a predetermined axial length.

Reference numeral 11 is a spring made of an electrically conductive, elastic wire material wound into a coil and its upper end as viewed in the figure is attached and electrically connected to the conductor 8.

As best shown in FIG. 13, a coil side elastic member 12 comprises an inner cylinder portion 12*b* having formed at its center a cylindrical fitting bore 12*a* for fitting and engaging a projecting portion 5*b* of the ignition coil 5. An outer cylinder portion 12*d* is provided in order that an annular engagement groove 12*c* is defined in cooperation with the inner cylinder portion 12*b*. These inner and outer cylinder portions 12*b* and 12*d* are made of silicone rubber in an integral, unitary structure.

Within the engagement groove 12*c* of the coil side elastic member 12, the thin-wall cylinder portion 7*d* of the insulating cover 7 is inserted and the outer periphery of the accommodating cylinder portion or the support cylinder 7*c* is bonded by a bonding agent 14 to the inner periphery of the outer cylinder portion 12*d*. In this case also, it is necessary that the conductor 8, the spring 13 and the high voltage terminal 5*a* of the ignition coil must be electrically insulated against the grounded member such as the cylinder head 1. Therefore, the electrically insulating bonding agent 14 is inserted between the outer periphery of the support sleeve 7*c* and the inner periphery of the outer cylindrical portion 12*d* in order not to generate a gap through which an electric current leaks. The support sleeve 7*c* is inserted into the engagement groove 12*c* after the bonding agent 14 is applied on its outer circumferential surface over a predetermined axial length.

Thus, the components from the insulating member 7 to the coil side elastic member 12 inclusive constitute the electrical connector 6.

The electrical connector 6 constructed as above described is fitted or engaged at the engagement bore 9*a* of the plug side elastic member 9 with the spark plug 3 with a predetermined press-fit and the spring 11 is in the compressed state to be urged against to establish a good electrical contact with the conductor 3*a* of the spark plug 3. Also, the engagement bore 12*a* of the coil side elastic member 12 is fitted over the projecting portion 5*b* of the ignition coil 5 and the conductor 8 is in contact with the high voltage terminal 5*a* through the spring 13.

When an ignition high voltage is generated by the ignition coil 5, it is introduced into the spark plug 3 through the high voltage terminal 5*a*, the spring 13, the conductor 8 and the spring 11. The high voltage terminal 5*a* of the ignition coil 5, the spring 13 and the connection end which is one end of the conductor 8 are covered and electrically insulated by the coil side elastic member 12. Also, the other end of the conductor 8, the coil spring 11 and the connection end to which the spark plug 3 is connected are covered and electrically insulated by the plug side elastic member 9. The space between the outer periphery 7*c* of the support sleeve 7*a* of the insulating cover and the engagement groove 9*c* of the plug side elastic member 9 as well as the space between the outer periphery of the ignition coil side support sleeve 7*c* of the insulating cover and the engagement groove 12*c* of the coil side elastic member 12 are filled with the bonding agents 10 and 14 in order not to generate leakage gaps therethrough and to bond them together.

Since the conventional ignition apparatus and electrical connector for an internal combustion engine are constructed as above described, in order to obtain the necessary insulation, the surface distance of each engaging portion must sufficiently be large or each bonding agent applied to the bonding portion must be evenly applied so that no leakage gap generates. However, the former measure causes difficulties in miniaturization and the latter easily causes uneven application of the bonding agent, posing the problem in that the leakage gap generates to degrade the insulation.

Further, when the support sleeve 7*a* of the insulation cover 7 is being inserted into the engagement groove 9*c* of the plug side elastic member 9, the bonding agent 10 applied on the outer circumference of the support sleeve 7*a* of the insulation cover 7 is wiped off, making the even bonding with no leakage gap therein difficult. A similar problem exists in the bonding between the support sleeve 7*c* of the insulation cover 7 and the soil side elastic member 12.

SUMMARY OF THE INVENTION

Accordingly, one object of the present invention is to provide an electric connector of ignition apparatus for an internal combustion engine free from the above discussed problems.

Another object of the present invention is to provide an electrical connector of an ignition apparatus for an internal combustion engine which is reliable in electrical insulation.

Another object of the present invention is to provide an electrical connector of an ignition apparatus for an internal combustion engine which is small and inexpensive.

A further object of the present invention is to provide an ignition apparatus for an internal combustion engine which is reliable in electrical insulation.

With the above objects in view, the present invention resides in an electrical connector for connecting a high voltage terminal of a spark plug of an internal combustion engine to an ignition coil comprising first and second electrically insulating caps each having a cylindrical engaging surface adapted to be attached to the spark plug and the ignition coil, respectively. An electrically insulating sheath, having at its opposite ends cylindrical engaging surfaces, is attached and engaged with the engaging surfaces of the insulating caps at its opposite ends so that at least one cylindrical engaging interface is defined therebetween. An electrical conductor is supported by, and extended through, the insulating sheath for electrically connecting the ignition coil and the high voltage terminal of the spark plug to each other. The electrical connector also comprises an electrically insulating structure, disposed in the engaging interface between the engaging surfaces of the caps and the sheath, for providing additional electrical insulation in the engaging interface.

The insulating structure may be one or a pair of circumferential annular ridges disposed on one of the engaging surfaces defining the engaging interface and a circumferential annular groove receiving the annular ridge therein on the other of the engaging surfaces defining the engaging interface.

The electrical connector may comprise an electrically insulating bonding agent disposed in the engaging interface between the engaging surfaces, which may or may not be a part of the insulating structure.

One of the insulating caps and the insulating sheath may comprise an annular wall having its central axis extending in parallel to the longitudinal axis of the electrical connector, the other of the insulating caps and the insulating sheath comprises an annular groove for receiving the annular wall therein. The insulating structure may comprise an electrically insulating bonding agent disposed between the engaging surfaces in the engaging interface.

The insulating structure of the electrical connector may be a circumferential annular space defined in the engaging interface between the engaging surfaces and a volume of electrically insulating bonding agent filled within the annular space. The annular space may be a groove disposed in the engaging interface, or the annular space within which the bonding agent is disposed may be located within the engaging interface and substantially closed, or the annular space within which the bonding agent is disposed may be located at an outer edge of the engaging interface between the engaging surfaces and open to the exterior.

One of the insulating caps and the insulating sheath may comprise an annular wall having its central axis extending in parallel to the longitudinal axis of the electrical connector, the other of the insulating caps and the insulating sheath comprises an annular groove for receiving the annular wall therein.

The annular space filled with the bonding agent may be defined between an annular surface section of the insulating sheath which is perpendicular to the longitudinal axis of the electrical connector and a lip of the insulating cap.

An ignition apparatus for an internal combustion engine comprises a spark plug and an ignition coil for generating a high voltage to be supplied to the spark plug and having a high voltage tower. An electrical connector is connected between the spark plug and the high voltage tower of the ignition coil for electrical connection therebetween. The electrical connector defines a connection interface between the connector and the high voltage tower, which includes an annular space circumferentially extending around an outer cylindrical surface of the high voltage tower defining the connection interface.

BRIEF DESCRIPTION OF THE DRAWINGS

The present invention will become more readily apparent from the following detailed description of the present invention taken in conjunction with the accompanying drawings, in which.

DESCRIPTION OF THE PREFERRED EMBODIMENTS

Figure 1:
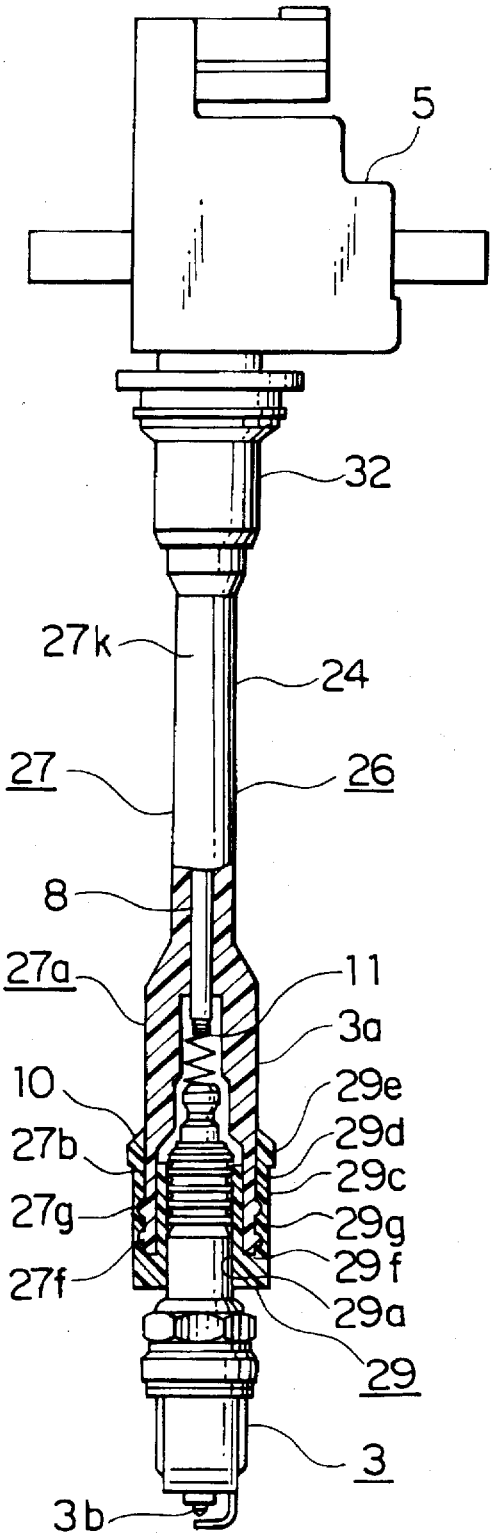
FIG. 1 is a sectional view illustrating one embodiment of an electrical connector for an internal combustion engine of the present invention.
Figure 2:
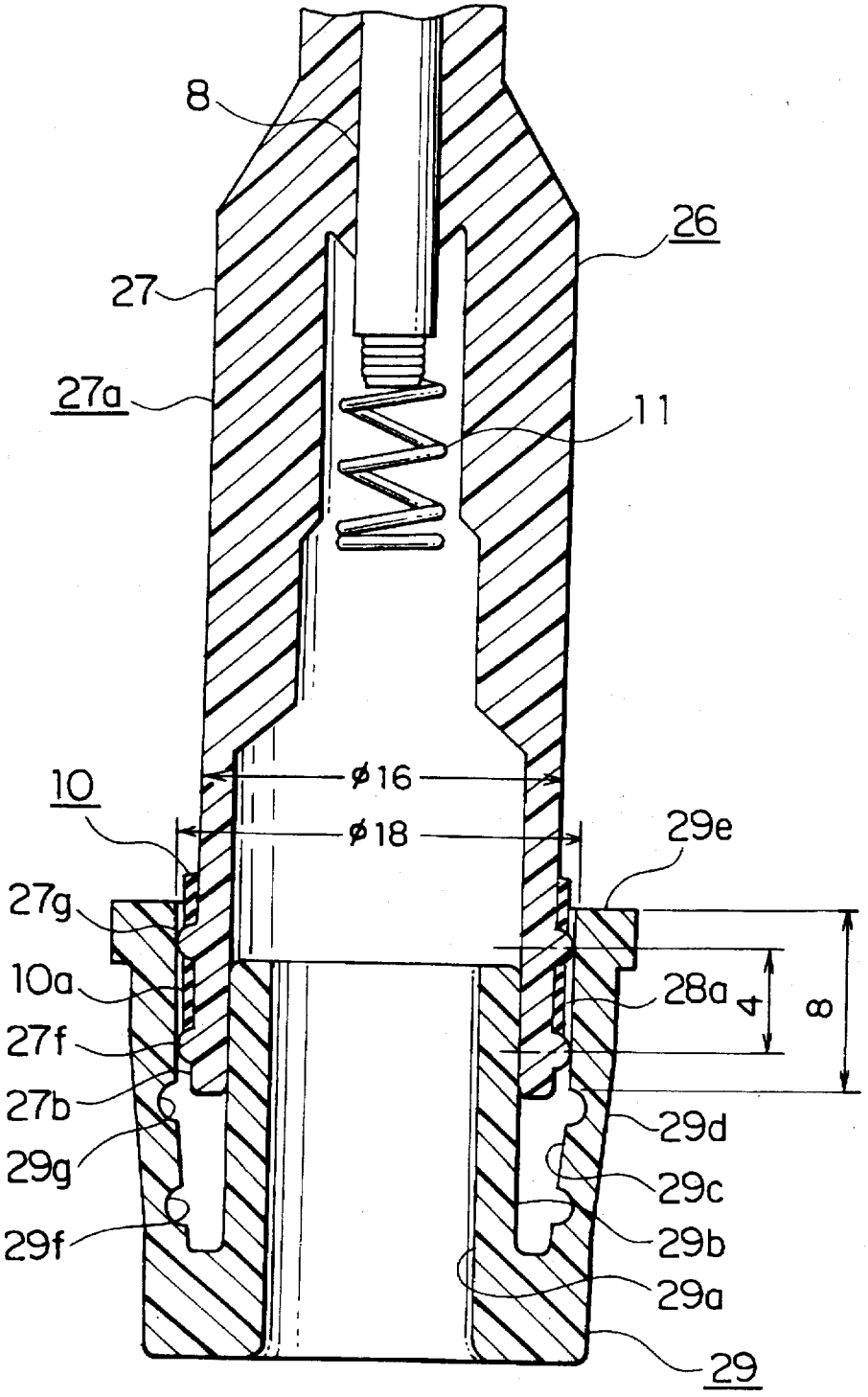
FIG. 2 is a sectional view of the main portion of the electrical connector when the insulating sheath shown in FIG. 1 is fitted to the plug side elastic member.
Figure 3:
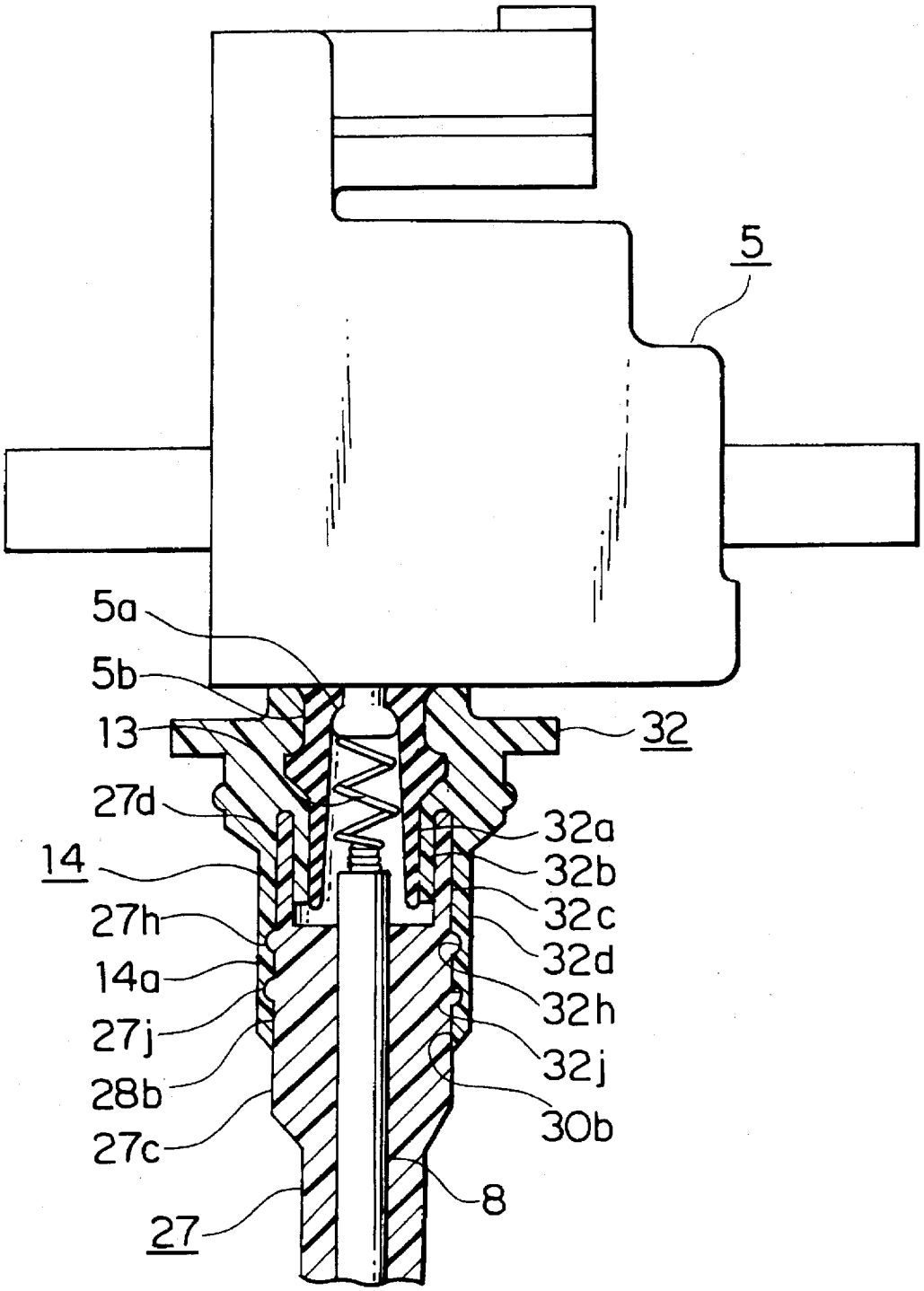
FIG. 3 is a sectional view of the coil side main portion of the electrical connector shown in FIG. 1.

FIGS. 1 to 3 illustrate one embodiment of an electrical connector 26 of the present invention as being used for connecting a spark plug 3 and an ignition coil 5 of an ignition apparatus for an internal combustion engine. The spark plug 3 has a high voltage terminal 3a to which a high tension voltage is applied, a spark gap 3b across which an ignition spark is generated and a body 3c to which the electrical connector 26 is attached. As best seen in FIG. 3, the ignition coil 5 comprises a high voltage terminal 5a from which a high voltage output is supplied and a high voltage tower 5b to which the electrical connector 24 is attached. The high voltage tower 5b is made of PBT (polybuthyrenetelephtalate).

The electrical connector 26 of the present invention comprises an electrically insulating sheath 27 made of a good electrically insulating material such as PBT. The insulating sheath 27 comprises a tubular body 27k and accommodating cylindrical portions 27a (FIG. 2) and 27c (FIG. 3).

The cylindrical portion 27a has an outer cylindrical surface 28a (FIG. 2) having an outer diameter of 16 mm and accommodates therein the high voltage terminal 3a of the spark plug 3 and an electrically conductive compression spring 11. The cylindrical portion 27a has at its open end a cylindrical thin wall portion 27b which has at its outer cylindrical surface 28a a pair of parallel circumferential annular projections or ridges 27f and 27g axially spaced apart by 4 mm from each other. The ridge 27f or 27g has a cross-sectional shape of a semi-circle having a radius of 1.0 mm. The outer cylindrical surface 28a which includes the annular ridges 27f and 27g defines an engaging surface which will be described in detail later.

As shown in FIG. 3, the cylindrical portion 27c of the insulating sheath 27 on the ignition coil side has an outer cylindrical surface 28b (FIG. 3) having an outer diameter of 16 mm and accommodates therein the high voltage tower 5b of the ignition coil 5 and an electrically conductive compression spring 11. The cylindrical portion 27c has at its end a cylindrical thin wall portion 27d. A pair of parallel circumferential annular projections or ridges 27h and 27j axially spaced apart by 5 mm from each other and have a cross-sectional shape of a semi-circle having a radius of 1.0 mm are disposed on the outer cylindrical wall of the cylindrical portion 27c. The outer cylindrical surface 28b of the cylindrical portion 27c, together with its annular ridges 27h and 27j, constitutes an engagement surface which will be described later in detail.

Extending through and supported by the insulating sheath 27 is an electrically conductive rod conductor 8 which is made of brass and rigid enough to be properly electrically and mechanically supported between the spark plug 3 and the ignition coil 5. Each end of the rod conductor 8 is brought into electrical contact with the ignition coil 5 or the spark plug 3 through the conductive springs 11 and 13 inserted therebetween.

The electrical connector 26 also comprises a first electrically insulating cap or a plug-side elastic member 29 which is substantially a hollow tubular member made of silicone rubber. The inner surface 29a of the insulating cap 29 is adapted to be attached to the cylindrical body 3c of the spark plug 3. The plug-side elastic member 29 has formed in its wall thickness dimension a deep annular engaging groove 29c defined between an outer cylindrical surface of the inner wall 29b and an inner cylindrical surface 30a of an outer wall 29d of the plug-side elastic member 29.

The inner cylindrical surface 30a of the outer wall 29d has formed therein a pair of parallel circumferential annular grooves 29f and 29g axially spaced apart by 4 mm from each other and have a cross-sectional shape of a semi-circle having a radius of 1.0 mm so that they snugly receive therein the pair of annular projections 27f and 27g disposed on the outer cylindrical surface 28a of the cylindrical portion 27c of the insulating sheath 27.

Thus, the inner cylindrical surface 30a including the annular grooves 29f and 29g of the outer wall 29d is brought into an intimate engagement with the outer cylindrical surface 28a of the insulating sheath 27, and the outer surface of the inner wall 29b is brought into an intimate engagement with the inner surface of the insulating sheath 27, whereby these engaging surfaces together define an engaging interface between the sheath 27 and the first insulating cap 29. Since the engaging interface is substantially U-shape in cross section, an additional distance along the interface and therefore an additional electrical insulation is provided in the engaging interface. In the illustrated embodiment, the axial distance measured along the engaging interface is the sum of inner and outer interfaces. This electrical distance is further increased by the annular ridges and grooves 27f, 27g and 29f, 29g. It can be said that either one of the insulating cap 29 and the insulating sheath 27 comprises an annular wall 27a having its central axis extending in parallel to the longitudinal axis of the electrical connector 26, the other of the insulating cap 29 and the insulating sheath 27 comprises an annular engaging groove 29c for receiving the annular wall 27a therein.

In order to even further strengthen the electrical insulation and mechanical stability, an electrically insulating bonding agent 10 is at least partially disposed between the sheath 27 and the insulating cap 29.

The electrical connector 26 also comprises a second electrically insulating cap or an ignition coil-side elastic member 32 which is substantially a hollow tubular member made of silicone rubber. The insulating cap 32 has an inner cylindrical surface adapted to be snugly attached to the cylindrical insulator 5b of the high tension tower 5a of the ignition coil 5. The ignition coil-side elastic member 32 has formed in its wall thickness dimension a deep annular engaging groove 32c defined between an outer cylindrical surface of the inner wall 32b and an inner cylindrical surface 30b of an outer wall 32d of the ignition coil-side elastic member 32.

The inner cylindrical surface 30b of the outer wall 32d has formed therein a pair of parallel circumferential annular grooves 32h and 32j axially spaced apart by 5 mm from each other and have a cross-sectional shape of a semi-circle having a radius of 1.0 mm so that they snugly receive therein the pair of annular projections 27h and 27j disposed on the outer cylindrical surface 28b of the cylindrical portion 27c of the insulating sheath 27.

Thus, the inner cylindrical surface 30b including the annular grooves 29h and 29j of the outer wall 32d is brought into an intimate engagement with the outer cylindrical surface 28b of the insulating sheath 27, and the outer surface of the inner wall 32b is brought into an intimate engagement with the inner surface of the insulating sheath 27, whereby these engaging surfaces together define an engaging interface between the engaging surfaces of the insulating sheath 27 and the second insulating cap 32. Since the engaging interface is substantially U-shaped in cross section, an additional distance along the interface and therefore an additional electrical insulation is provided in the engaging interface. This electrical distance is further increased by the annular ridges and grooves 27h, 27j and 29h, 29j.

In order to further strengthen the electrical insulation and mechanical stability, an electrically insulating bonding agent 10a such as of a silicone rubber type is at least partially disposed between the sheath 27 and the insulating cap 29.

While the annular ridges 27f, 27g and 27h, 27j and the annular grooves 29f, 29g and 32h, 32j for receiving the annular ridges therein are provided in the outer section of the engaging interface having the U-shaped cross-section in the illustrated embodiment, their position may be changed to any other position within the engaging interface.

In assembling the electrical connector 26 of the present invention, as illustrated in FIG. 2, the silicone rubber type bonding agent 10a is applied onto the outer circumference of the support cylindrical portion 27a of the insulating sheath 27 over a predetermined axial distance and the support cylindrical portion 27a is inserted into the engagement groove 29c formed in the first elastic member 29. At this time, the bonding agent 10a is maintained on the cylindrical surface between the pair of annular ridges 27f and 27g. When the cylindrical portion 27a is being inserted into the engagement groove 29c of the first elastic member 29, the outer cylindrical wall 29d is outwardly expanded. At this time, the bonding agent 10a disposed between the annular ridges 27f and 27g on the cylindrical surface of the cylindrical portion 27a is prevented from being scraped off by the first elastic member 29 because only the outer most portion of the annular edges 27f and 27g are brought into contact with the inner surface of the engagement groove 29c and the outer surface of the cylindrical portion does not contact the elastic member 29 until the annular ridges 27f and 27g fit into the respective annular grooves 29f.

When the thin wall cylinder portion 27b is inserted into the final position within the engaging groove 29c, the annular grooves 29f and 29g receive therein the annular ridges 27f and 27g and the outer cylindrical wall 29d of the first elastic member 29 is allowed to return to its original position by the elasticity, whereby the bonding agent 10a is elastically pressed and spread evenly in the engaging interface. Therefore, a stable bonding can be achieved ensuring that the leakage gap is not generated, so that the reliability of the electrical insulation between the grounded component such as the cylinder head 1 and the conductive components such as the conductor rod 8, the spring 11 and the conductive portion 3a of the spark plug 3 is increased.

In order to ensure that the plug-side elastic member 29 does not disengage from the insulating sheath 27 when the insulating sheath 27 is held and the electrical connector is to be attached and detached from the ignition plug 3, a bonding agent 10a is disposed over a suitable bonding region necessary for securely connecting the support cylinder portion 27a of the insulating sheath 27 and the outer cylindrical wall 29d of the plug-side elastic member 29. It is to be noted that no special skill or experience is necessary for the application of the bonding agent 10a and the insertion of the thin-walled cylindrical portion 27a of the insulating sheath 27 into the engagement groove 29c of the plug-side elastic member 29, making the job management simple and easy.

Then, in a manner similar to that just explain in conjunction with the plug-side elastic member 29 shown in FIG. 2, a silicone rubber type bonding agent 14 is applied onto the outer circumference of the support cylindrical portion 27c of the insulating sheath 27 over a predetermined axial distance and the support cylindrical portion 27c is inserted into the engagement groove 32c formed in the second elastic member 32 as shown in FIG. 3. At this time, the bonding agent 14 is maintained on the cylindrical surface between the pair of annular ridges 27h and 27j. When the cylindrical portion 27c is being inserted into the engagement groove 32c of the second elastic member 32, the outer cylindrical wall 32d is outwardly expanded. At this time, the bonding agent 14 disposed between the annular ridges 27h and 27j on the cylindrical surface of the cylindrical portion 27c is prevented from being scraped off by the first elastic member 32 because only the outer most portion of the annular edges 27h and 27j are brought into contact with the inner surface of the engagement groove 32c and the outer surface of the cylindrical portion does not contact the second elastic member 32 until the annular ridges 27h and 27j fit into the respective annular grooves 32h and 32j.

When the thin wall cylinder portion 27c is inserted into the final position within the engaging groove 32c, the annular grooves 32h and 32j receive therein the annular ridges 27h and 27j and the outer cylindrical wall 32d of the first elastic member 32 is allowed to return to its original position by the elasticity, whereby the bonding agent 14 is elastically pressed and spread evenly in the engaging interface. Therefore, a stable bonding can be achieved ensuring that the leakage gap is not generated.

It is to be noted that no special skill or experience is necessary for the application of the bonding agent 10a and the insertion of the thin-walled cylindrical portion 27a of the insulating sheath 27 into the engagement groove 29c of the plug-side elastic member 29, making the job management simple and easy.

Thus, the electrical connector 26 of the present invention comprises the insulating sheath 27, the rod conductor 8, the first or plug-side elastic member 29, the bonding agent 10, the spring 11, the second or coil-side elastic member 32, the spring 32 and the bonding agent 14. The structure not described above may be similar to that of the electrical connector of the conventional design.

The electrical connector 26 as above described is detachably attached at its coil-side elastic member 32 to the insulator 5b of the high tension terminal of the ignition coil 5 in order to establish an electrical connection between the high tension terminal 5a of the ignition coil 5 and one end of the conductor rod 8 of the connector 26 through the spring 13. Also, the plug-side elastic member 29 is fitted at its engaging bore 29a over the ignition plug 3 with a predetermined press fit and the other end of the conductor rod 8 is electrically connected to the ignition plug 3 through the conductive spring 11. The engagements between the plug-side elastic member 29 and the ignition plug 3 and between the coil-side elastic member 32 and the ignition coil 5 can be disengaged by manually pulling the insulating sheath 27 when necessary.

Figure 4:
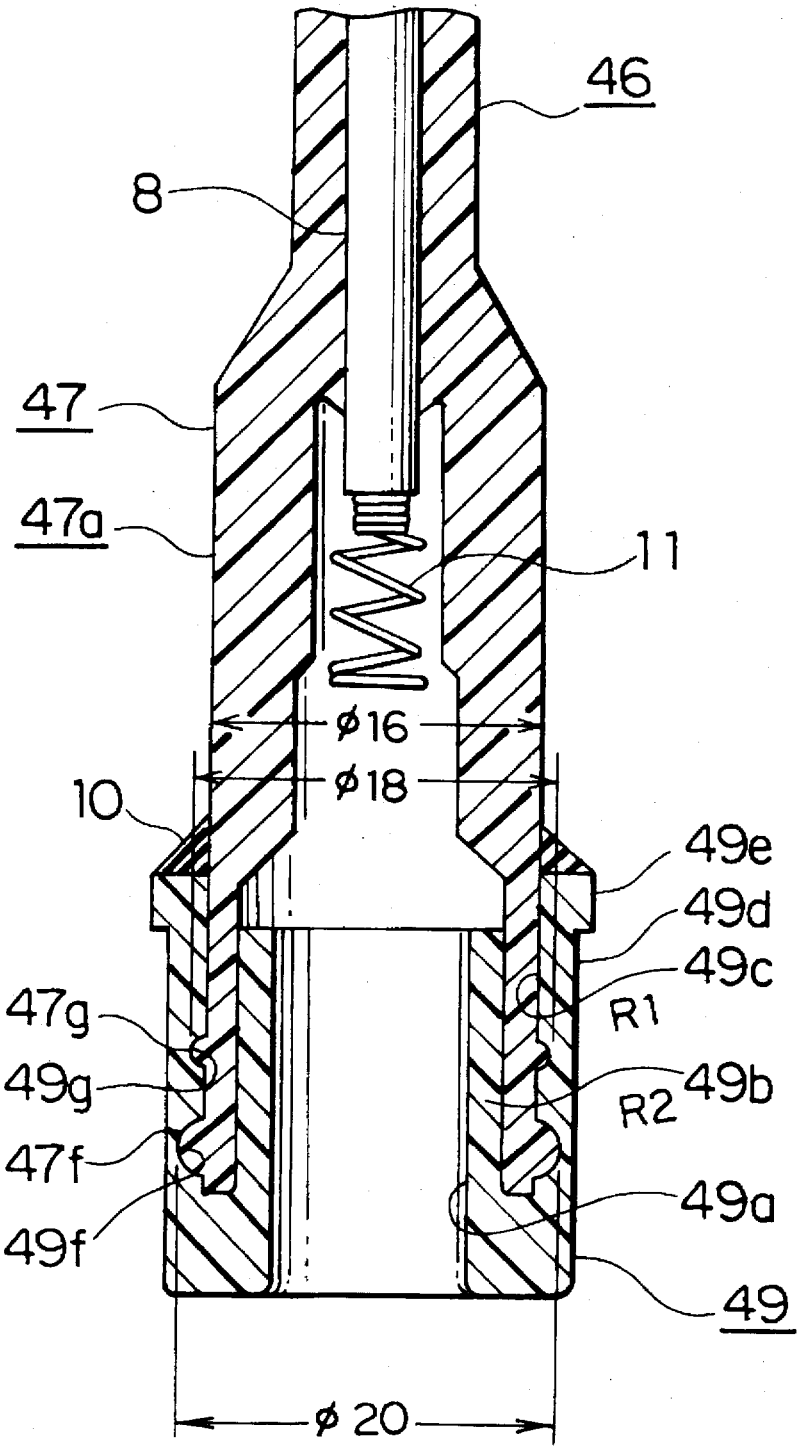
FIG. 4 is a sectional view of the spark plug side main portion of the electrical connector illustrating another embodiment of the present invention.

FIG. 4 illustrates a plug-side end of an electrical connector 46 of another embodiment of the present invention. In the electrical connector 46, an insulating sheath 47 is made of PBT and the end portion of the plug-side cylindrical portion 47*a* of the insulating sheath 47 has an increased outer diameter of 16 mm. The cylindrical portion 47*a* includes a thin wall cylindrical portion 47*b* which has formed thereon a first annular projection or ridge 47*f* of a semi-circular cross-section having a radius of 2.0 mm and a second annular projection or ridge 47*g* of a semi-circular cross-section having a radius of 1.0 mm. The first annular ridge 47*f* and the second annular ridge 47*g* are axially spaced apart by 4 mm from each other. A conductive spring 11 is attached to the conductor rod 8 within the support cylindrical portion 47*a*.

A plug-side elastic member 49 is a substantially hollow tubular member having a substantially U-shaped cross section and integrally formed of a silicone rubber having a suitable elasticity. The elastic member 49 comprises an inner cylindrical portion 49*b* defining a central engagement bore 49*a* in which the spark plug 3 is snugly accommodated, an outer cylindrical portion 49*d* defining an engaging groove 49*c* between it and the inner cylindrical portion 49*b*, and an annular reinforcing flange 49*e* disposed at a free end (an end upper as viewed in FIG. 4) of the outer cylindrical portion 49*d*. The outer cylindrical portion 49*d* has an inner cylindrical surface which has formed therein a first annular groove 49*f* of a semi-circular cross-section having a radius of 2.0 mm and a second annular groove 49*g* of a semi-circular cross-section having a radius of 1.0 mm. The first annular groove 49*f* and the second annular groove 49*g* are axially spaced apart by 4 mm from each other. These A conductive spring 11 is attached to the conductor rod 8 within the support cylindrical portion 47*a*.

Other components such as the coil-side elastic member may have a structure similar to that illustrated in FIGS. 1 to 3.

In assembling the electrical connector 46 of this embodiment, the silicone rubber type bonding agent 10 is applied onto the outer circumference of the support cylindrical portion 47*a* of the insulating sheath 47 over a predetermined axial distance and the support cylindrical portion 47*a* is inserted into the engagement groove 49*c* formed in the first elastic member 49. At this time, the bonding agent 10 is maintained on the cylindrical surface between the pair of annular ridges 47*f* and 47*g* because the bonding agent 10 disposed between the annular ridges 47*f* and 47*g* on the cylindrical surface of the cylindrical portion 47*a* is prevented from being scraped off by the first elastic member 49 because only the outer most portion of the annular edges 47*f* and 47*g* are brought into contact with the inner surface of the engagement groove 49*c* and the outer surface of the cylindrical portion does not contact the elastic member 49 until the annular ridges 47*f* and 47*g* fit into the respective annular grooves 49*f*.

When the thin wall cylinder portion 47*b* is inserted into the final position, the bonding agent 10 is elastically pressed and spread evenly in the engaging interface. Therefore, a stable bonding can be achieved ensuring that the leakage gap is not generated, so that the reliability of the electrical insulation is improved.

In this embodiment, since the first annular ridge 47*f* which first comes into contact with the outer cylindrical portion 49*d* of the elastic member 49 has a height larger than that of the second annular ridge 47*g*, the insertion of the support cylinder portion 47*a* is easy and a larger space for preventing the bonding agent from being scraped off is provided, resulting in a easier assembly.

Figure 5:
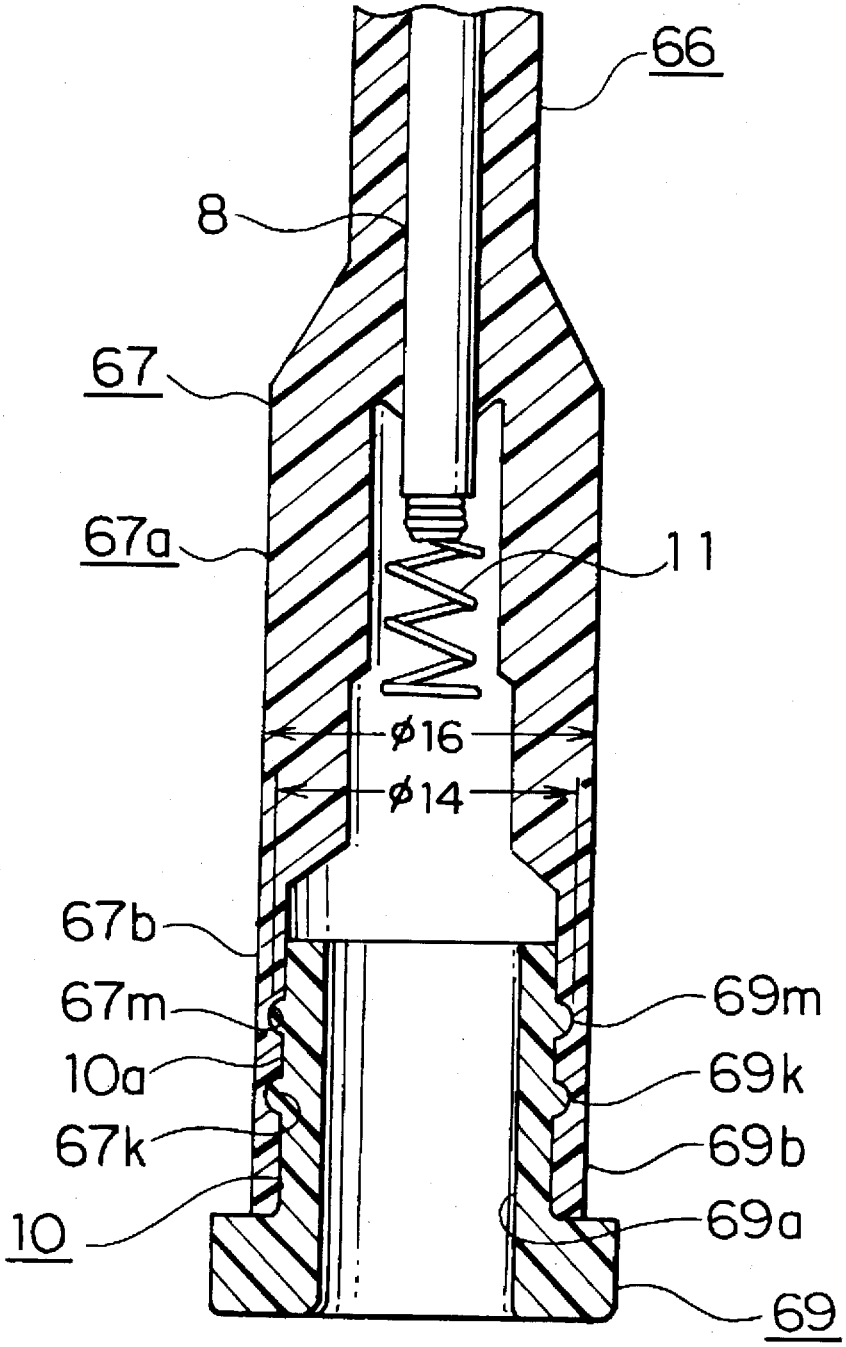
FIG. 5 is a sectional view of the spark plug side main portion of the electrical connector illustrating another embodiment of the present invention.

FIG. 5 illustrates a plug-side end of an electrical connector 66 for an ignition apparatus for an internal combustion engine of another embodiment of the present invention. The coil-side end of the electrical connector may have a similar structure as that illustrated in FIG. 5 or those described in conjunction with the previous embodiments. In this embodiment, an insulating sheath 67 has a support cylinder portion 67*a* which has a thin wall cylindrical portion 67*b* having an inner cylindrical engaging surface provided with a pair of circumferentially extending annular grooves 67*k* and 67*m* axially spaced apart from each other. The thin wall cylindrical portion 67*b* has snugly press fitted in its engaging surface a plug-side elastic member 69, which is generally a flanged hollow cylindrical member.

The plug-side elastic member 69 has an inner surface 69*a* to which the spark plug 3 is press fitted, an outer engaging surface on which a pair of annular ridges 69*k* and 69*m* axially spaced apart form each other are provided and a radially extending annular flange 69*n*. The inner engaging surface including the annular grooves 67*k* and 67*m* of the thin wall cylindrical portion 67*b* and the outer surface including the annular ridges 69*k* and 69*m* of the plug-side elastic member 69 are brought into intimate contact and defines an engaging interface between the sheath 67 and the elastic member 69. Also, an annular end face of the thin wall portion 67*b* and an annular side surface to which the end face of the thin wall portion 67*b* abuts constitutes another engaging interface defined between the sheath 67 and the plug-side elastic member 69.

In other respects, the electrical connector may have the same or similar structure to those illustrated and explained in conjunction with the previous embodiments.

In this embodiment, since the elastic member 69 is not provided with an engaging groove axially extending in the thickness dimension of the member and engages with the sheath 67 only at its outer surface, the structure of the elastic member 69 is simple and small, requiring only a small amount of expensive silicone rubber.

Figure 6:
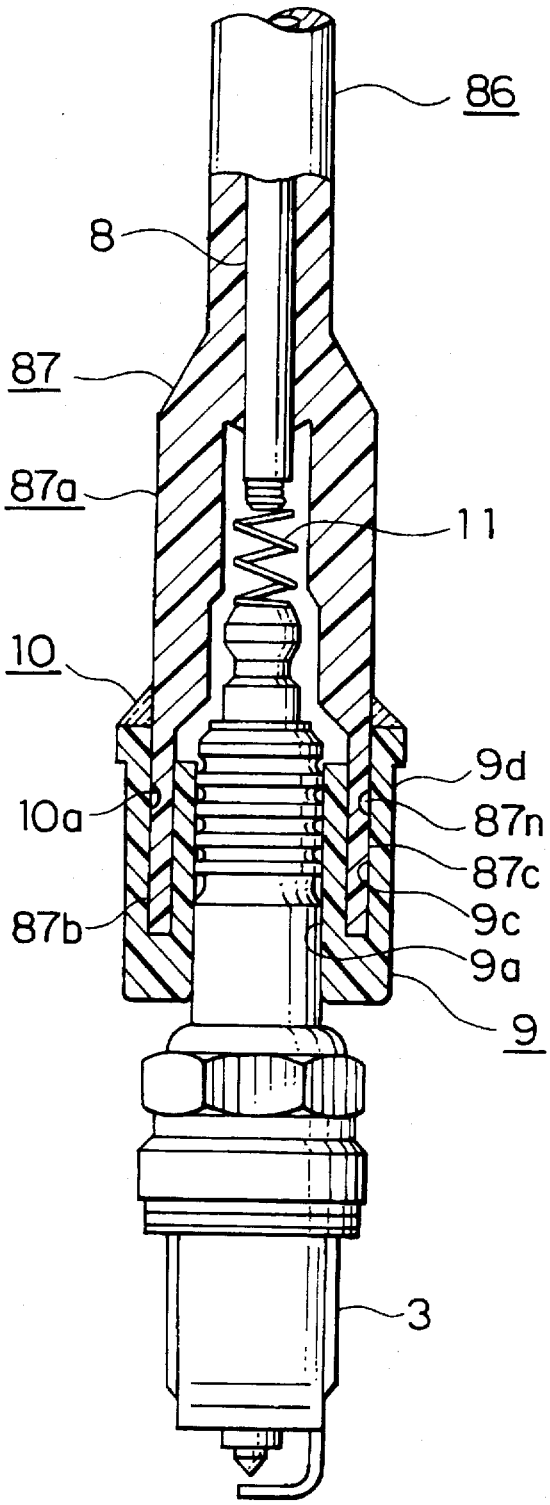
FIG. 6 is a sectional view of the spark plug side main portion of the electrical connector illustrating another embodiment of the present invention.

FIG. 6 illustrates another embodiment of the electrical connector of the present invention, in which the general structure is similar to that illustrated in FIGS. 1 and 2. The structure of this electrical connector is different in that no ridge-and-groove arrangement shown in FIGS. 1 and 2 in which annular ridges and annular grooves are brought into engagement with each other is provided in the engaging interface. Instead, the electrical connector 86 of this embodiment comprises an insulating sheath 87 including a support cylinder portion 87*a* having a thin wall cylindrical portion 87*b*, and the thin wall cylindrical portion 87*b* has formed in its outer cylindrical surface 87*c* a circumferentially extending annular groove 87*n* of a semicircular cross-section. In this illustrated embodiment, the outer diameter of the support cylinder portion 87*a* is 16 mm and the radius of the semi-circle cross-section of the annular groove 87*n* is 1.0 mm.

The electrical connector 86 also comprises a plug-side elastic member 9 having inner and outer cylindrical wall portions 9*a* and 9*d* and similar to that shown in FIGS. 1 and 2 except that there is no annular groove or ridge provided in its inner surface of the outer cylindrical wall 9*d* defining the engaging groove 9*c*. It is seen that an engaging interface between the sheath 87 and an elastic member 9 is defined along the inner and outer surfaces of the thin wall portion 87*b* of the sheath 87 and that this engaging interface includes a circumferentially extending annular space defined between the semicircular groove 87*n* and the inner surface of the outer wall member 9*d*. This annular space is filled with an electrically insulating bonding agent 10*a*. Thus, it can be said that the annular space within which the bonding agent 10*a* is disposed is located within the engaging interface and substantially closed. A volume of an insulating bonding agent 10 is also disposed between the outer surface of the support cylinder 87*a* of the sheath 87 and an annular end surface at the open end (at the upper end as viewed in FIG. 6) of the elastic member 9.

In this embodiment also, the bonding agent 10*a* disposed within the annular groove 87*n* is not scraped off even when the sheath 87 is being inserted into the engaging groove 9*c* of the elastic member 9, and even when the bonding agent applied to the sheath 87 is scraped by the elastic member 9, the scraped bonding agent is collected within the annular groove 87*n*.

Figure 7:
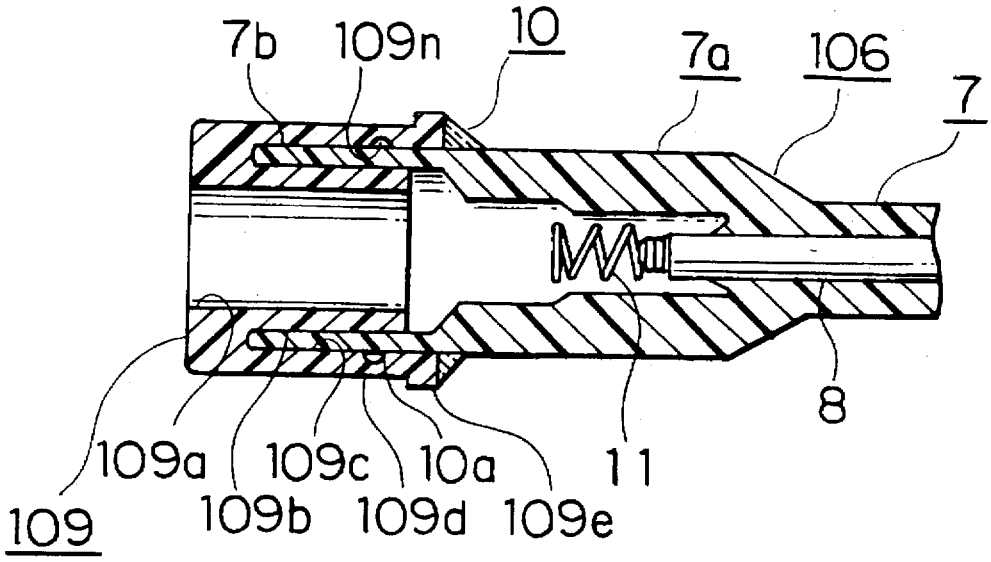
FIG. 7 is a sectional view of the spark plug side main portion of the electrical connector illustrating another embodiment of the present invention.

FIG. 7 illustrates another electrical connector 106 in which its general structure is similar to that illustrated in FIG. 6 and different only in that an annular groove filled with the bonding agent 10*a* is formed in an elastic member 109 rather than an insulating sheath 7.

More particularly, the electrical connector 106 of this embodiment comprises an insulating sheath 7 including a support cylinder portion 7*a* having a thin wall cylindrical portion 7*b*. The thin wall cylindrical portion 7*b* has a smooth outer cylindrical surface and no circumferentially extending annular groove is provided therein.

The electrical connector 106 comprises a plug-side elastic member 109 having inner and outer cylindrical wall portions 109*b* and 109*d*, respectively, and a semi-circular annular groove 109*n* is provided in the inner surface of the outer cylindrical wall 109*d*. The annular space defined by the annular groove 109*n* is filled with the electrically insulating bonding agent 10*a*. In the illustrated example, the annular groove 109*n* has a radius of the semi-circular cross-section of 2.0 mm.

In this embodiment also, the bonding agent 10a disposed within the annular groove 109*n* is not scraped off even when the sheath 7 is inserted into the engaging groove 109*c* of the elastic member 109.

Figure 8:
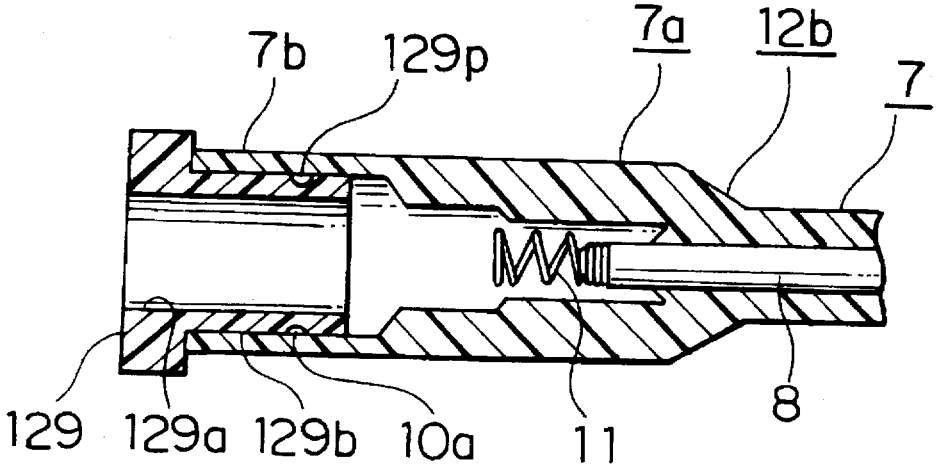
FIG. 8 is a sectional view of the spark plug side main portion of the electrical connector illustrating another embodiment of the present invention.

In FIG. 8, in which an electrical connector 126 has a general structure similar to that illustrated in FIG. 5 and different only in that no ridge-and-groove arrangement such as shown in FIG. 5, in which the annular ridges and annular grooves are brought into engagement with each other, is provided in the engaging interface and that an annular groove filled with the bonding agent 10*a* is formed in an elastic member 129 rather than an insulating sheath 7.

More particularly, the electrical connector 126 of this embodiment comprises an insulating sheath 7 including a support cylinder portion 7*a* having a thin wall cylindrical portion 7*b*. The thin wall cylindrical portion 7*b* has a smooth inner and outer cylindrical surfaces and no circumferentially extending annular groove is provided therein.

The electrical connector 126 comprises a plug-side elastic member 129 having a single cylindrical wall including inner and outer surfaces 129*a* and 129*b*, respectively, and a semi-circular annular groove 129*p* having a semi-circular cross-section of a radius of 1.0 mm is provided in the outer surface of the elastic member 129. The annular space defined by the annular groove 129*p* is filled with the electrically insulating bonding agent 10*a*.

In this embodiment also, the bonding agent 10*a* disposed within the annular groove 129*p* can be prevented from being scraped off even when the sheath 7 is inserted into the engaging central bore of the elastic member 129 with a simple structure.

Figure 9:
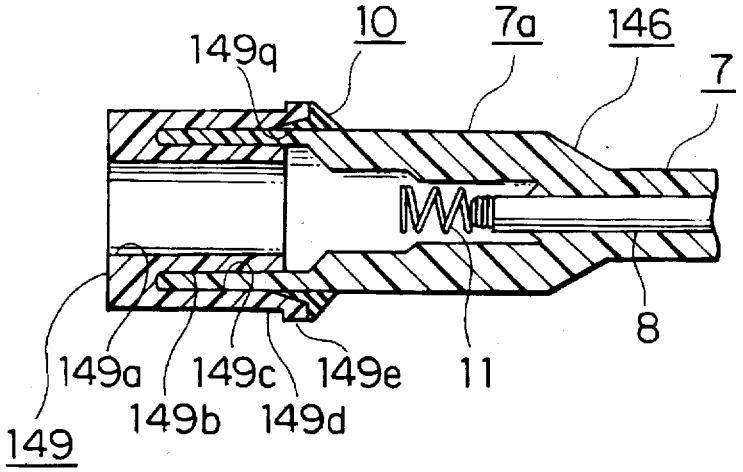
FIG. 9 is a sectional view of the spark plug side main portion of the electrical connector illustrating another embodiment of the present invention.

FIG. 9 illustrates still another embodiment of the electrical connector of the present invention, in which an electrical connector 146 comprises a sheath 7 similar to the sheath 7 shown and described in conjunction with FIG. 7 and an elastic member 149 having a central bore 149*a*, inner and outer cylindrical wall portions 149*b* and 149*d*, respectively defining therebetween an engaging groove 149*c*. The elastic member 149 does not have an annular groove corresponding to the annular groove 109*n* of the embodiment shown in FIG. 7 for example, but the elastic member 149 comprises a flanged end 149*e* which has a tapered or bevelled inner lip surface defining, in cooperation with the outer cylindrical surface of the cylindrical portion 7*a* of the insulating sheath 7, an annular space of a substantially wedge-shaped cross-section. The wedge-shaped annular space and the end surface of the flange is filled with the electrically insulating bonding agent 10. Thus, the wedge-shaped annular space within which the bonding agent is disposed is located at an outer edge of the engaging interface between the engaging surfaces between the sheath 7 and the elastic member 149 and open to the exterior.

Figure 10:
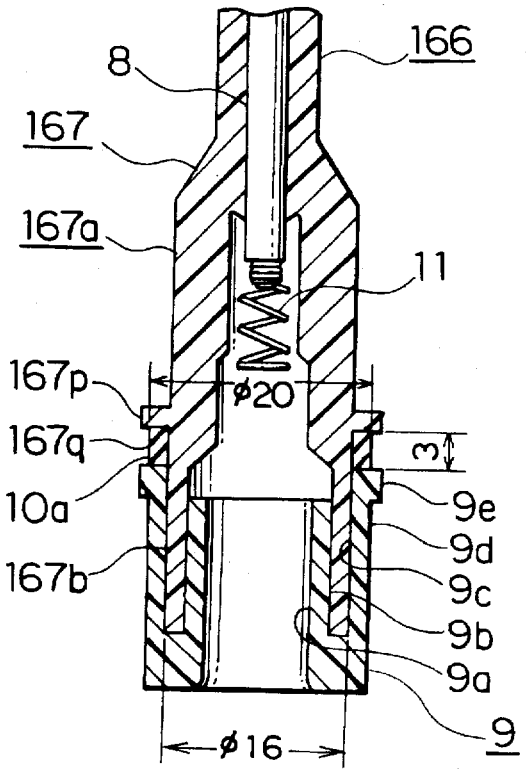
FIG. 10 is a sectional view of the spark plug side main portion of the electrical connector illustrating another embodiment of the present invention.

FIG. 10 illustrates another embodiment of the electrical connector 166 of the present invention in which an insulating sheath 167 has a support cylinder portion 167*a* having an outer diameter of 16 mm and provided with a thin wall cylindrical portion 167*b* and a flange 167*p* extending along the circumference of the outer cylindrical surface of the cylinder portion 167*a*. The thin wall cylindrical portion 167*b* is inserted into and received within an axial groove 9*c* defined between inner and outer cylindrical walls 9*b* and 9*d* of the elastic member 9. The elastic member 9 has an inner cylindrical surface 9*a* for snugly rifling with the spark plug and a flanged open end 9*e* and an annular end surface which is in opposite relationship with the flange 167*p* on the insulating sheath 167 in the axial direction with an axial space of 3 mm defined therebetween. This axial space which extend through the entire circumference of the sheath 167 is filled with an electrically insulating bonding agent 10*a*. In the illustrated embodiment, the height or the radial dimension of the annular flange 167*p* and the flanged end 9*e* are 3 mm, and the thickness of the bonding agent 10*a* filed within the annular space is 2 mm.

During the assembly, as the thin wall portion 167*a* of the sheath 167*a* on which the bonding agent 10 is applied is inserted into the engaging groove 9*c*, the bonding agent 10 applied is scraped by the flanged end 9*e* of the elastic member 9. However, the bonding agent 10 scraped off is collected as the volume of the bonding agent 10*a* within the annular space defined between the flanged end 9*e* and the flange 167*p* on the sheath 167, so that the electrical seal between the elastic member 9 and the insulating sheath 167 is maintained. In this embodiment, it can be said that the annular space filled with the bonding agent 10*a* is defined between a radially and circumferentially extending surface of the insulating sheath which may be a side surface of the flange 167*p* which is perpendicular to the longitudinal axis of the electrical connector and a lip of the insulating cap 9 which may be the flanged end 9*e*.

Figure 11:
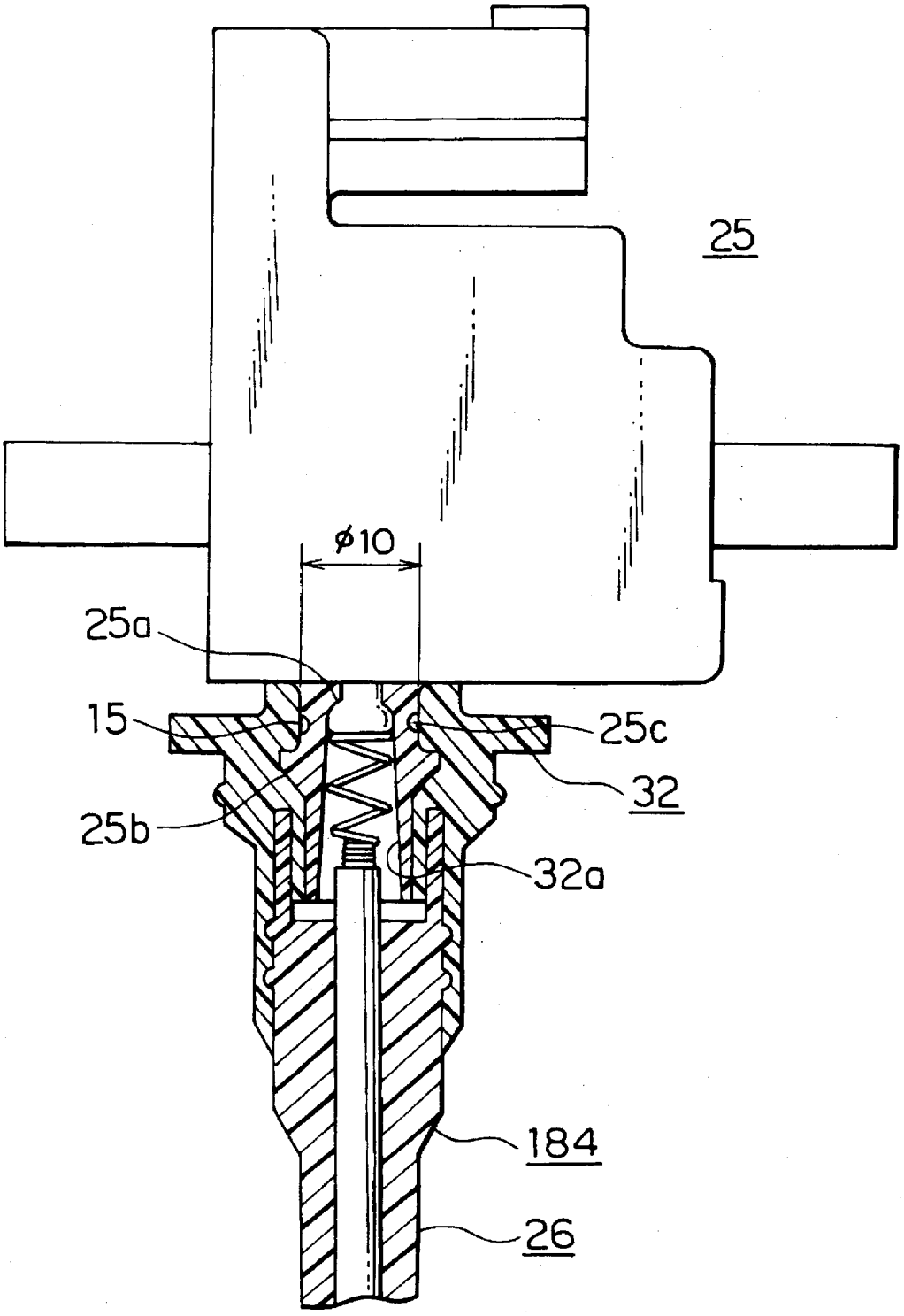
FIG. 11 is a sectional view of the ignition coil side main portion of the electrical connector illustrating another embodiment of the present invention.
Figure 12:
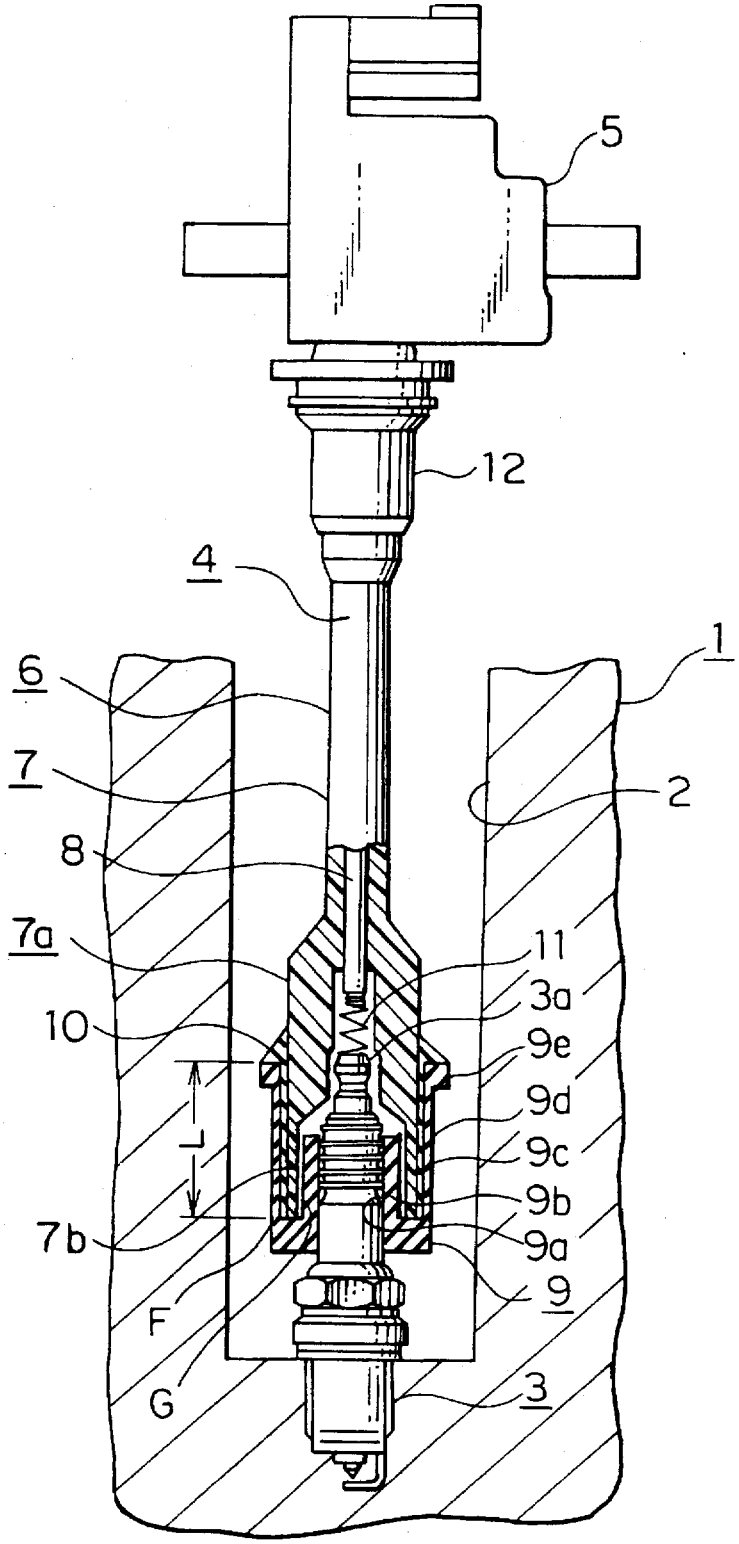
FIG. 12 PRIOR ART
FIG. 12 is a sectional view of a conventional ignition apparatus for an internal combustion engine.
Figure 13:
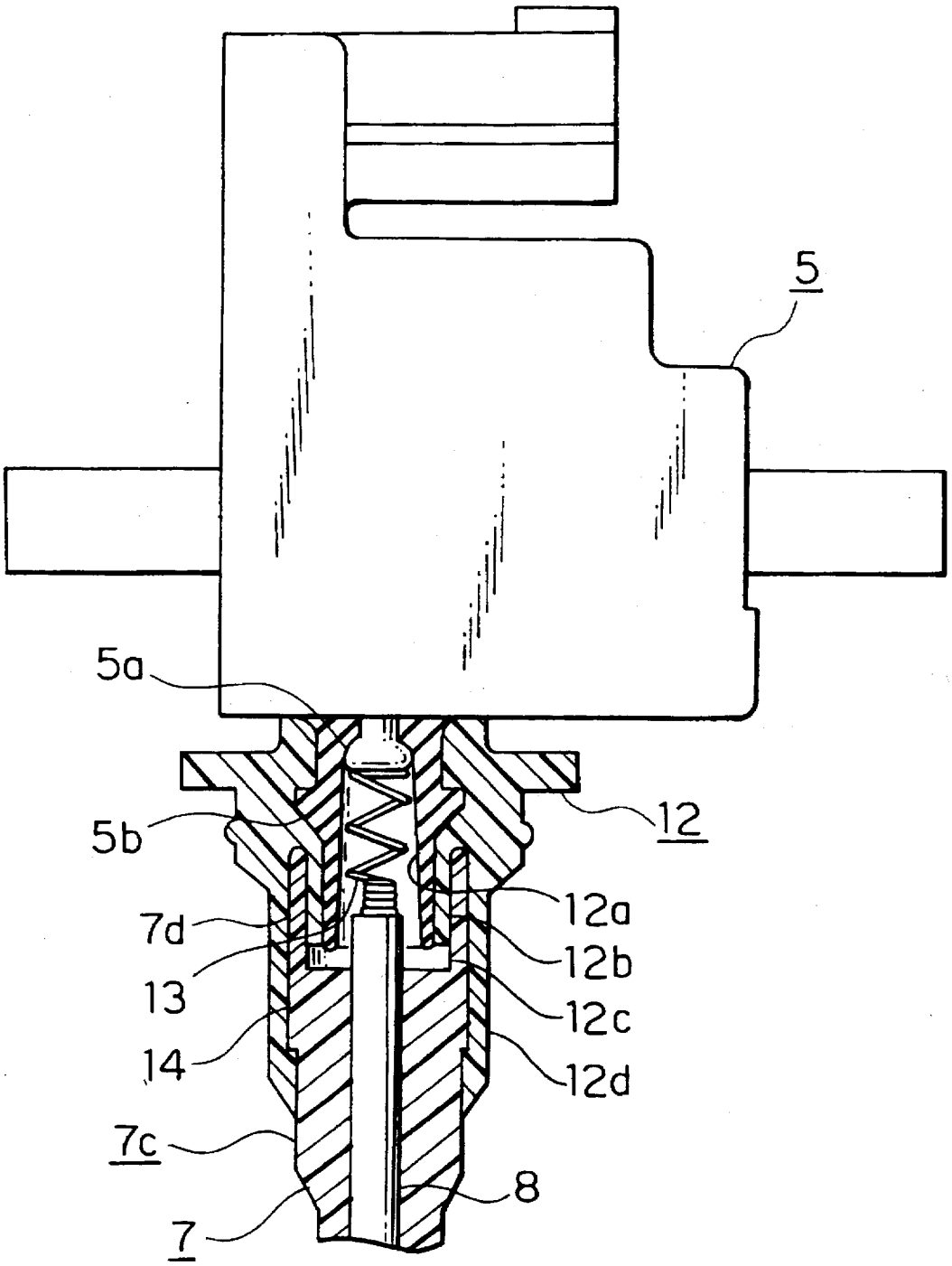
FIG. 13 PRIOR ART
FIG. 13 is a sectional view of the main portion of the connection portion of the ignition coil of the ignition apparatus illustrated in FIG. 12.

FIG. 11 illustrates an ignition coil 25 and a coil-side end section of an electrical connector 26 of an ignition apparatus 184 of the present invention. The electrical connector 26 of the ignition apparatus 184 has a general structure similar to that of the electrical connector 26 shown and described in conjunction with FIG. 3. The ignition coil 25 comprises a high voltage tower having a high voltage terminal 25*a* from which a high voltage output is supplied and a tubular high voltage insulator 25*b* surrounding the high voltage terminal 25*a* and to which coil-side elastic member 32 of the electrical connector 26 is attached. The high voltage insulator **25*b* has at its outer surface an annular ridge which is received within a complementary-groove formed in the elastic member 32** for elastic mechanical connection therebetween.

According to the present invention, the high voltage insulator **25*b* which is made of PBT has a circumferentially extending annular groove 25*c* having a semicircular cross-section at its outer surface having a diameter of 10 mm. Since the high voltage insulator 25*b* does not have a complementary-shaped annular projection or ridge in the inner surface corresponding to the annular groove 25*c*, when the elastic member 32 is attached to the high voltage insulator 25*b*, the annular groove 25*c* defines a substantially closed annular space in cooperation with the cylindrical inner surface of the elastic member 32. This annular space which is a part of the engaging interface between the elastic member 32 and the high voltage insulator 25*b* is filled with an electrically insulating bonding agent 15** which may be a silicone rubber type.

When the elastic member 32 is fitted over the high voltage insulator **25*b* with the bonding agent applied to its outer surface, the engaging interface including the annular space defined by the groove 25*c* is filled with the bonding agent 15**, allowing a good electrical seal to be established in the engaging interface.

While the ignition apparatus has been described as having the particular electrical connector 26 shown in FIGS. 1 to 3 and 11, any other electrical connector of suitable structure illustrated and described in conjunction with FIGS. 4 to 10 may equally be used.

As has been described, the electrical connector for connecting a high voltage terminal of a spark plug of an internal combustion engine to an ignition coil of the present invention comprises first and second electrically insulating caps each having a cylindrical engaging surface adapted to be attached to the spark plug and the ignition coil, respectively. An electrically insulating sheath having at its opposite ends cylindrical engaging surfaces is attached and engaged with the engaging surfaces of the insulating caps at its opposite ends so that at least one cylindrical engaging interface is defined therebetween. An electrical conductor is supported by and extended through the insulating sheath for electrically connecting the ignition coil and the high voltage terminal of the spark plug to each other. The electrical connector also comprises an electrically insulating structure, disposed in the engaging interface between the engaging surfaces of the caps and the sheath, for providing additional electrical insulation in the engaging interface. Therefore, the reliability of the electrical insulation and electrical seal along the engaging interface is improved.

The insulating structure may be one or a pair of circumferential annular ridge disposed on one of the engaging surfaces defining the engaging interface and a circumferential annular groove receiving the annular ridge therein on the other of the engaging surfaces defining the engaging interface. Also, an electrically insulating bonding agent may disposed in the engaging interface between the engaging surfaces, which may or may not be a part of the insulating structure. Therefore, a long engaging interface can be obtained increasing the insulating strength and improving the mechanical strength and the insulation reliability.

The ignition apparatus for an internal combustion engine of the present invention comprises a spark plug and an ignition coil for generating a high voltage to be supplied to the spark plug and having a high voltage tower. An electrical connector is connected between the spark plug and the high voltage tower of the ignition coil for electrical connection therebetween, and the electrical connector defines a connection interface between the connector and the high voltage tower, which includes an annular space circumferentially extending around an outer cylindrical surface of the high voltage tower defining the connection interface. Therefore, the connection interface between the high voltage tower and the electrical connector has a good electrical and mechanical stability.

What is claimed is:

1. An electrical connector for connecting a high voltage terminal of a spark plug of an internal combustion engine to an ignition coil, comprising:

first and second electrically insulating caps adapted to be attached to the spark plug and the ignition coil, respectively, said insulating caps each having a pair of at least partially opposed cylindrical engaging surfaces;

an electrically insulating sheath having at its opposite ends cylindrical engaging surfaces which are in engagement with said engaging surfaces of said insulating caps, defining at least two cylindrical engaging interfaces therebetween;

an electrical conductor supported by and extending through said insulating sheath for electrically connecting the ignition coil and the high voltage terminal of the spark plug to each other; and electrically insulating means, disposed in at least one engaging interface between said engaging surfaces of said caps and said sheath, for providing additional electrical insulation in said engaging interface, said electrically insulating means comprising a pair of circumferential annular ridges disposed on one of said engaging surfaces and a pair of circumferential annular grooves on another of said engaging surfaces for receiving said pair of circumferential annular ridges therein.

2. An electrical connector as claimed in claim 1, further comprising an electrically insulating bonding agent disposed in at least one engaging interface.

3. An electrical connector for connecting a high voltage terminal of a spark plug of an internal combustion engine to an ignition coil, comprising:

first and second electrically insulating caps adapted to be attached to the spark plug and the ignition coil, respectively, said insulating caps each having a cylindrical engaging surface;

an electrically insulating sheath having at its opposite ends cylindrical engaging surfaces which are in engagement with said engaging surfaces of said insulating caps, defining at least one cylindrical engaging interface therebetween;

an electrical conductor supported by and extending through said insulating sheath for electrically connecting the ignition coil and the high voltage terminal of the spark plug to each other; and electrically insulating means, disposed in said engaging interface between said engaging surfaces of said caps and said sheath, for providing additional electrical insulation in said engaging interface, said electrically insulating means comprising a pair of circumferential annular ridges disposed on one of said engaging surfaces and a pair of circumferential annular grooves on the other of said engaging surfaces for receiving said pair of circumferential annular ridges therein, one circumferential annular groove of said pair of circumferential annular grooves spanning a larger annular diameter than the other circumferential annular groove of said pair of circumferential annular grooves.

4. An electrical connector as claimed in claim 1, wherein one of said pair of annular ridges positioned forward as viewed in the direction of insertion during assembly has a larger radial dimension than the other of said pair of annular ridges.

5. An electrical connector as claimed in claim 4, further comprising an electrically insulating bonding agent disposed in one of said engaging interfaces between said engaging surfaces.

6. An electrical connector as claimed in claim 3, further comprising an electrically insulating bonding agent disposed in said one of engaging interfaces between said engaging surfaces.

7. An electrical connector as claimed in claim 3, wherein one circumferential annular groove of said pair of circumferential annular grooves which is positioned forward as viewed in the direction of insertion during assembly has a larger annular diameter than the other circumferential annular groove of said pair of annular ridges.

8. An electrical connector as claimed in claim 7, further comprising an electrically insulating bonding agent disposed in one of said engaging interfaces between said engaging surfaces.

* * * * *